US007318705B2

(12) United States Patent
Uchino et al.

(10) Patent No.: US 7,318,705 B2
(45) Date of Patent: Jan. 15, 2008

(54) VARIABLE DISPLACEMENT PUMP WITH COMMUNICATION PASSAGE

(75) Inventors: Kazuyoshi Uchino, Saitama (JP); Shigeyuki Miyazawa, Saitama (JP)

(73) Assignee: Unisia JKC Steering Systems, Co., Ltd., Kanagawa (JP)

( * ) Notice: Subject to any disclaimer, the term of this patent is extended or adjusted under 35 U.S.C. 154(b) by 541 days.

(21) Appl. No.: 10/889,126

(22) Filed: Jul. 13, 2004

(65) Prior Publication Data

US 2005/0019174 A1 Jan. 27, 2005

(30) Foreign Application Priority Data

Jul. 25, 2003 (JP) ..... 2003-279867

(51) Int. Cl.
*F04B 49/00* (2006.01)

(52) U.S. Cl. ..... 417/220

(58) Field of Classification Search ..... None
See application file for complete search history.

(56) References Cited

U.S. PATENT DOCUMENTS 2,811,926 A * 11/1957 Robinson, Jr. ..... 418/26
4,496,288 A * 1/1985 Nakamura et al. ..... 417/213
5,618,165 A * 4/1997 Larsson et al. ..... 417/220
5,895,209 A * 4/1999 Miyazawa ..... 418/26
6,524,076 B2 2/2003 Konishi
6,709,242 B2 * 3/2004 Watanabe et al. ..... 417/220
6,736,604 B2 * 5/2004 Okada et al. ..... 417/213
6,790,013 B2 * 9/2004 Hunter et al. ..... 417/220
6,896,489 B2 * 5/2005 Hunter et al. ..... 417/220
7,018,178 B2 * 3/2006 Hunter et al. ..... 417/219
2004/0156727 A1 8/2004 Uchino

FOREIGN PATENT DOCUMENTS

DE 102 40 409 A1 3/2003
JP 2003-74479 A 3/2003
KR 10-201995 B1 6/1999

OTHER PUBLICATIONS

U.S. Appl. No. 10/890,243, filed Jul. 14, 2004, Uchino et al.

* cited by examiner

*Primary Examiner*—Thomas Denion
*Assistant Examiner*—Douglas J. Duff
(74) *Attorney, Agent, or Firm*—Foley & Lardner LLP

(57) ABSTRACT

A variable displacement pump includes a rear cover and side plate arranged on both sides of a cam ring and making slide contact with the cam ring. The rear cover has an end face on the side of the cam ring, which is formed with a suction port. A seal member is arranged in a chamber formed between a pump housing and the cam ring and for dividing the chamber into two portions that define first and second working chambers. A connection groove and terminal groove are formed in the end face of the rear cover to provide fluid communication between the suction port and the second working chamber.

6 Claims, 7 Drawing Sheets

VARIABLE DISPLACEMENT PUMP WITH COMMUNICATION PASSAGE

BACKGROUND OF THE INVENTION

The present invention relates to a variable displacement pump which serves as a source for supplying the hydraulic pressure to a hydraulic device such as an automotive power steering apparatus, and more particularly, to the variable displacement pump having discharge controlled by changing the volume of a pump main part.

Typically, the variable displacement pump comprises a rotor rotated by a driving shaft, vanes mounted to the outer periphery of the rotor to be movable radially, and a cam ring eccentrically arranged on the outer periphery of the rotor and having a roughly circular inner-peripheral surface. Due to the rotor and cam ring being offset to each other, when the rotor rotates, the vanes move radially in accordance therewith with the front ends making slide contact with the inner-peripheral surface of the cam ring. Thus, the volume of pump chambers each formed between circumferentially adjacent vanes is increased or decreased continuously.

Some variable displacement pumps further comprise a mechanism for variably controlling the volume of the pump chambers. With such variable displacement pump, the cam ring is swingably arranged on the outer periphery of the rotor, and has both sides slidably closed by closing members. The volume of the pump chambers can arbitrarily be adjusted by changing the amount of eccentricity between the rotor and the cam ring through adjustment of oscillation of the cam ring. The cam ring is swingably arranged inside a roughly elliptic adaptor ring. The inside of the adaptor ring has first and second working chambers defined in first and second swing directions of the cam ring.

Suction and discharge passages are connected to the suction and discharge areas within the cam ring, respectively. An orifice is provided to the discharge passage. The first working chamber is constructed to introduce therein working fluid having pressure controlled by a control valve. The second working chamber is constructed to accommodate a spring for biasing the cam ring to the first working chamber, and always introduce therein low-pressure working fluid from the suction passage. The control valve is operated in response to a pressure difference between the upstream and downstream sides of the orifice to control working fluid introduced into the first working chamber in accordance with the pressure difference.

With the above variable displacement pump, the second working chamber has suction-side low pressure maintained at all times, whereas the first working chamber has pressure controlled in accordance with the pressure difference between the upstream and downstream sides of the orifice. Thus, an inconvenience can be eliminated that, under the conditions of low pump rotational speed where an increase in the flow rate of working fluid is desired (wherein the cam ring is maximally displaced to the first working chamber to maximize the amount of eccentricity), high-pressure working fluid leaks to the low-pressure side from the first working chamber through clearances there around.

The closing member disposed at the side of the cam ring is formed with a suction port which opens to the suction area of the cam ring and a discharge port which opens to the discharge area of the cam ring. The suction and discharge ports are connected to the suction and discharge passages, respectively. This closing member is also formed with a low-pressure introduction hole extending axially to connect the second working chamber and the suction passage, through which low-pressure working fluid of the suction passage is always introduced into the second working chamber.

SUMMARY OF THE INVENTION

With the above variable displacement pump, however, since the low-pressure introduction hole extending axially parallel to the suction port is formed in one closing member to always maintain the pressure within the second working chamber at low pressure, the suction passage needs to be arranged at the rear of the low-pressure introduction hole, raising a problem of considerably lowering the layout flexibility of the suction passage.

It is, therefore, an object of the present invention to provide a variable displacement pump which allows enhanced design flexibility of the pump with the pressure within the second working chamber being always maintained at low pressure.

The present invention provides generally a variable displacement pump, which comprises: a rotor rotated by a driving shaft, the rotor comprising a plurality of vanes mounted to be retractable radially; a cam ring arranged on a periphery of the rotor to be swingable with respect to the rotor; a pair of closing members arranged on both sides of the cam ring, the closing members making slide contact with the cam ring, at least one closing member having an end face on a side of the cam ring, the end face being formed with a suction port; a seal member arranged in a chamber formed between a pump housing and the cam ring, the seal member dividing the chamber into two portions that define first and second working chambers; a spring arranged in the second working chamber, the spring biasing the cam ring to the first working chamber; a suction passage which introduces a working fluid into a suction area within the cam ring, the suction area serving to suck the working fluid through the suction port, the suction passage and the second working chamber being always in fluid communication during pump operation; a discharge passage which supplies the working fluid from a discharge area within the cam ring to the outside; a communication passage formed in the at least one closing member substantially along the end face thereof, the communication passage providing fluid communication between the suction port and the second working chamber; an orifice provided to the discharge passage; and a control valve operated by a pressure difference between upstream and downstream sides of the orifice, the control valve controlling a pressure of the working fluid to be introduced into the first working chamber.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
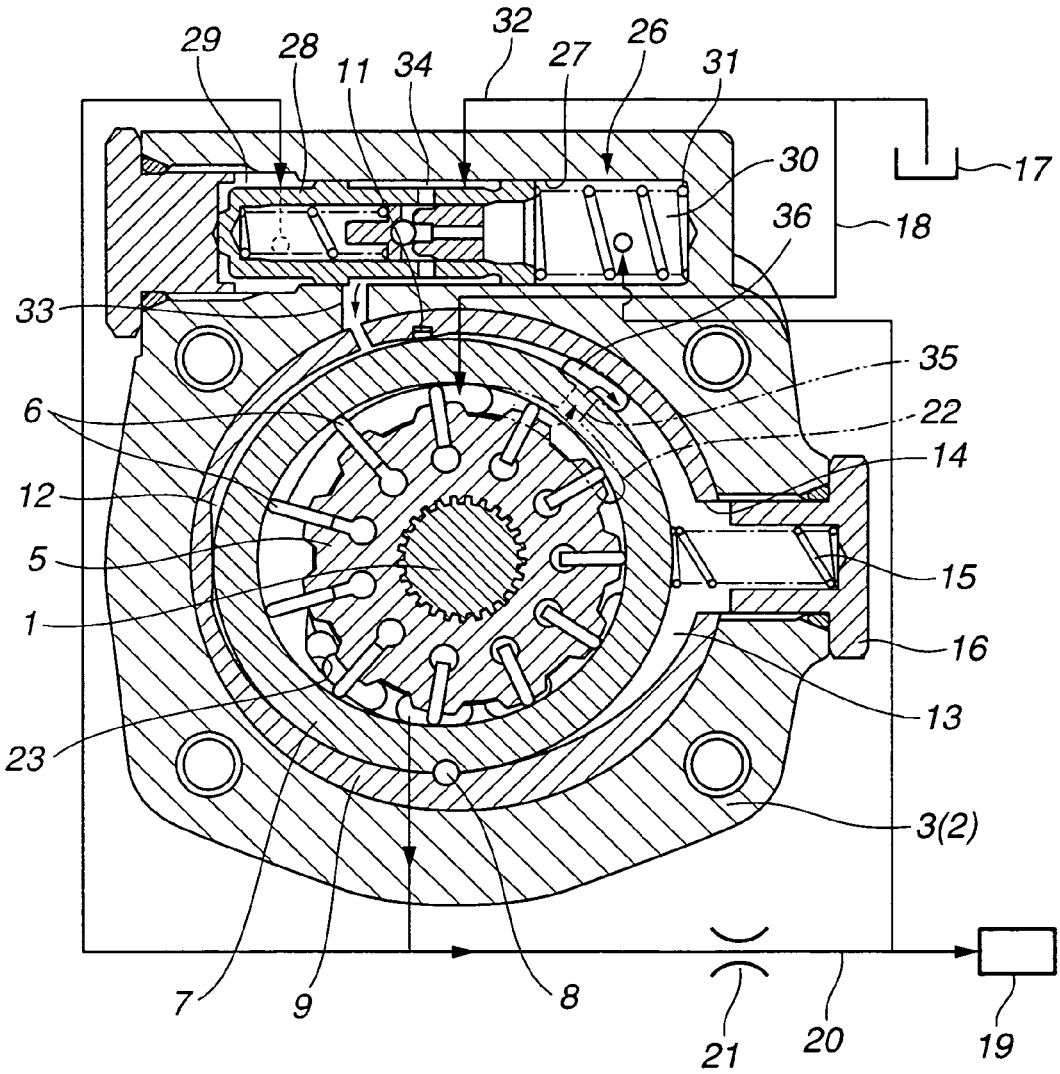
FIG. 1 is a sectional view taken along the line 1-1 in FIG. 2, showing an embodiment of a variable displacement pump according to the present invention.

Referring to the drawings, a description is made about an example of variable displacement pump embodying the present invention.

Figure 2:
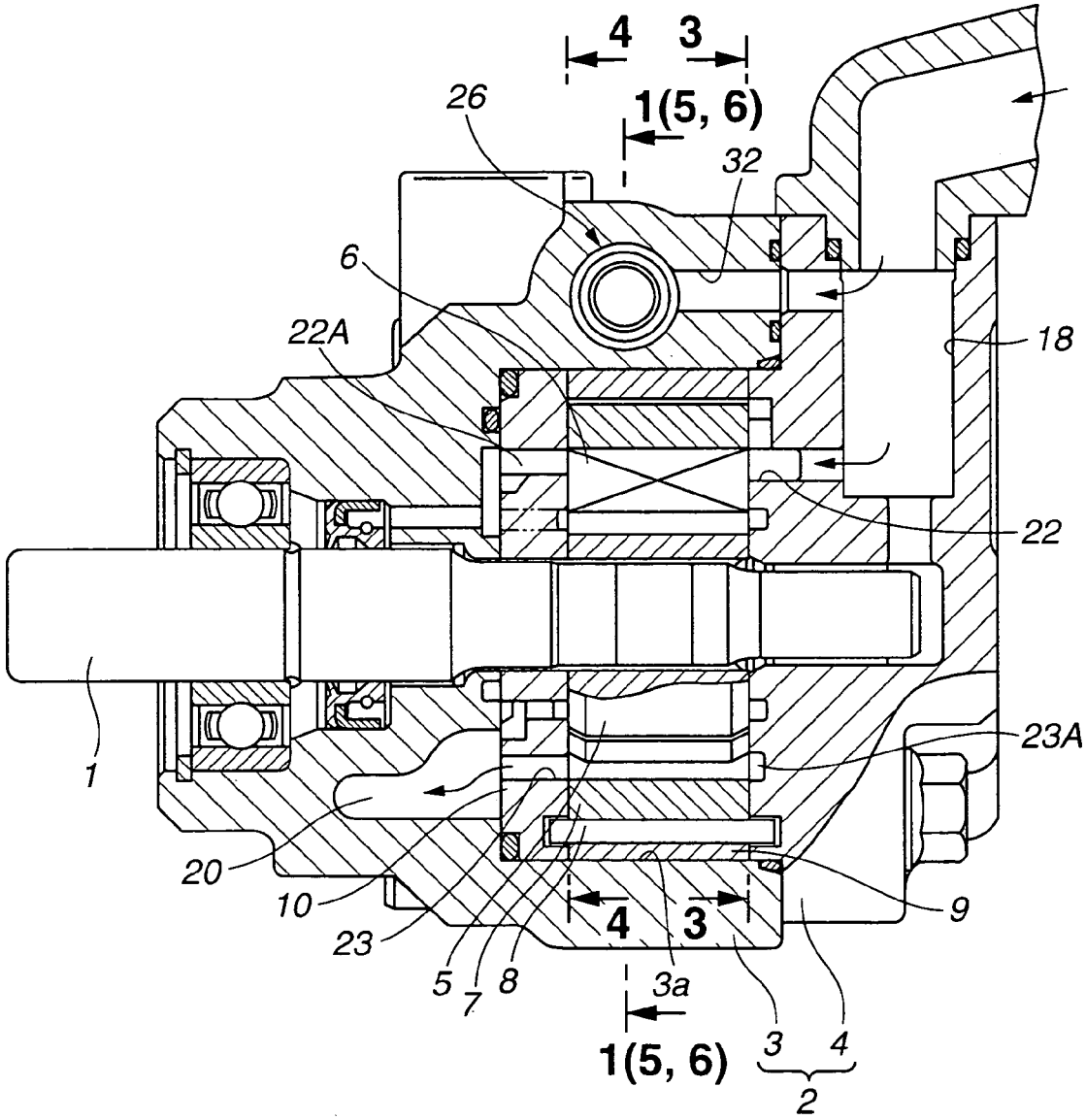
FIG. 2 is a longitudinal sectional view showing the embodiment of the present invention.

Referring to FIGS. 1-6, there is shown an embodiment of the present invention. Referring to FIG. 2, the variable displacement pump serves as a source for supplying the hydraulic pressure to a hydraulic device such as a power steering apparatus, and comprises a driving shaft 1 rotated by an engine and a housing 2 comprising a main body 3 having a concave 3*a* for accommodating a pump main body and a rear cover 4 attached to main body 3 to conceal concave 3*a*. Driving shaft 1 is rotatably supported to pump housing 2, and has a rotor 5 coupled thereto to be rotatable together. Referring also to FIG. 1, rotor 5 comprises slots formed radially in the outer periphery and vanes 6 held therein to be movable radially.

A cam ring 7, which constitutes together with rotor 5 the pump main part, accommodates rotor 5 on the inner-periphery side. Cam ring 7 is formed with a roughly circular inner cam face with which a front end of vanes 6 makes slide contact. Part of the outer periphery of cam ring 7 (lower end shown in FIG. 1) is swingably supported on pump housing 2 by a pin 8. Through oscillation about pin 8, cam ring 7 can adjust an amount of eccentricity with respect to rotor 5. Note that the center of cam ring 7 is displaced roughly in the cross direction as viewed in FIG. 1 by oscillation of cam ring 7.

With the variable displacement pump, in the ordinary state, cam ring 7 is offset with respect to the center of rotation of rotor 5. Thus, when rotor 5 rotates with the front end of vanes 6 making slide contact with the inner-peripheral surface of cam ring 7, the volume of the pump chambers formed between adjacent vanes 6 is increased or decreased, thereby achieving continuous pump operation. And when the amount of eccentricity between cam ring 7 and rotor 5 is changed, the rate of change of volume of the pump chambers varies to change the pump capacity accordingly.

Referring to FIGS. 1 and 2, an adaptor ring 9 is engaged in concave 3*a* of pump housing 2, inside of which a space is formed to accommodate cam ring 7. A side plate 10 is accommodated, together with adaptor ring 9, in concave 3*a*. Adaptor ring 9 is held to housing 2 in an anti-rotational way by pin 8 which forms the center of oscillation of cam ring 7, and has an inner-peripheral surface formed roughly elliptically to allow oscillating displacement of cam ring 7. Side plate 10 is arranged opposite to rear cover 4 to hold adaptor ring 9 therebetween. The side of cam ring 7 is slidably closed by the side face of side plate 10 and the inner end face of rear cover 4. In this embodiment, side plate 10 and rear cover 4 constitute closing members.

A seal member 11 is arranged on the inner-peripheral surface of adaptor ring 9 at the position opposite to pin 8 to extend axially. Seal member 11 makes close contact with the outer-peripheral surface of cam ring 7 while allowing displacement or oscillation of cam ring 7. Seal member 11 cooperates with pin 8 to define a first working chamber 12 and a second working chamber 13 in an inside space of adaptor ring 9. When maximally displaced to first working chamber 12 as shown in FIG. 1, cam ring 7 has maximum amount of eccentricity with respect to rotor 5.

A large-diameter through hole 14 is formed in a peripheral wall of adaptor ring 9 at the position facing second working chamber 13, through which a biasing spring or coil spring 15 is interposed between cam ring 7 and pump housing 2. Coil spring 15 serves to bias cam ring 7 to first working chamber 12. Cam ring 7 swings in accordance with a balance between the pressure within first working chamber 12 and a force of coil spring 15. One end of coil spring 15 is supported on a sealing plug 16 mounted to housing main body 3.

Referring to FIGS. 1 and 2, pump housing 2 is formed with a suction passage 18 for introducing working fluid from an outside tank 17 to the suction area within cam ring 7 (roughly upper-half area shown in FIG. 1) and a discharge passage 20 for feeding working fluid from the discharge area within cam ring 7 (roughly lower-half area shown in FIG. 1) to a power cylinder or actuator 19 of the power steering apparatus. An orifice 21 is provided to discharge passage 20.

Figure 3:
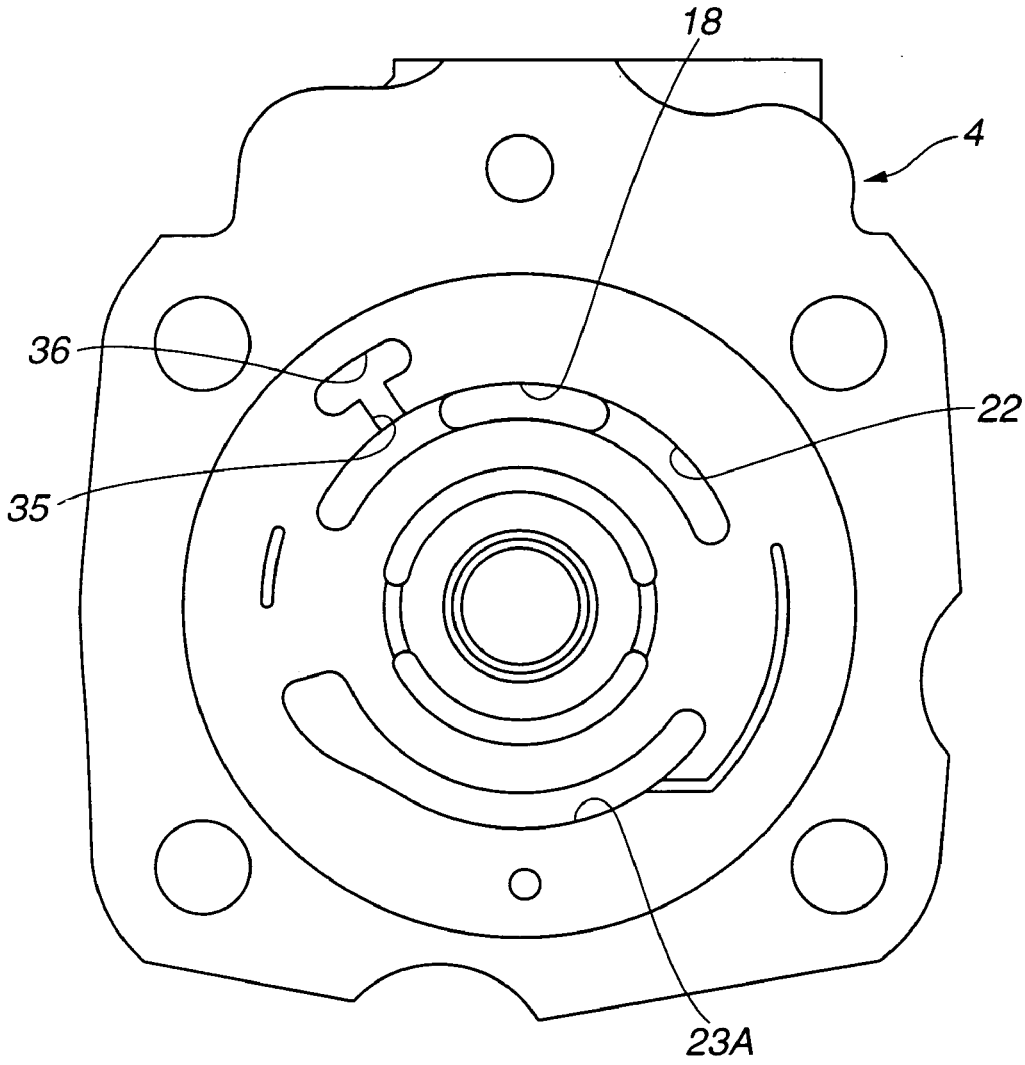
FIG. 3 is an end view seen from the line 3-3 in FIG. 2.
Figure 4:
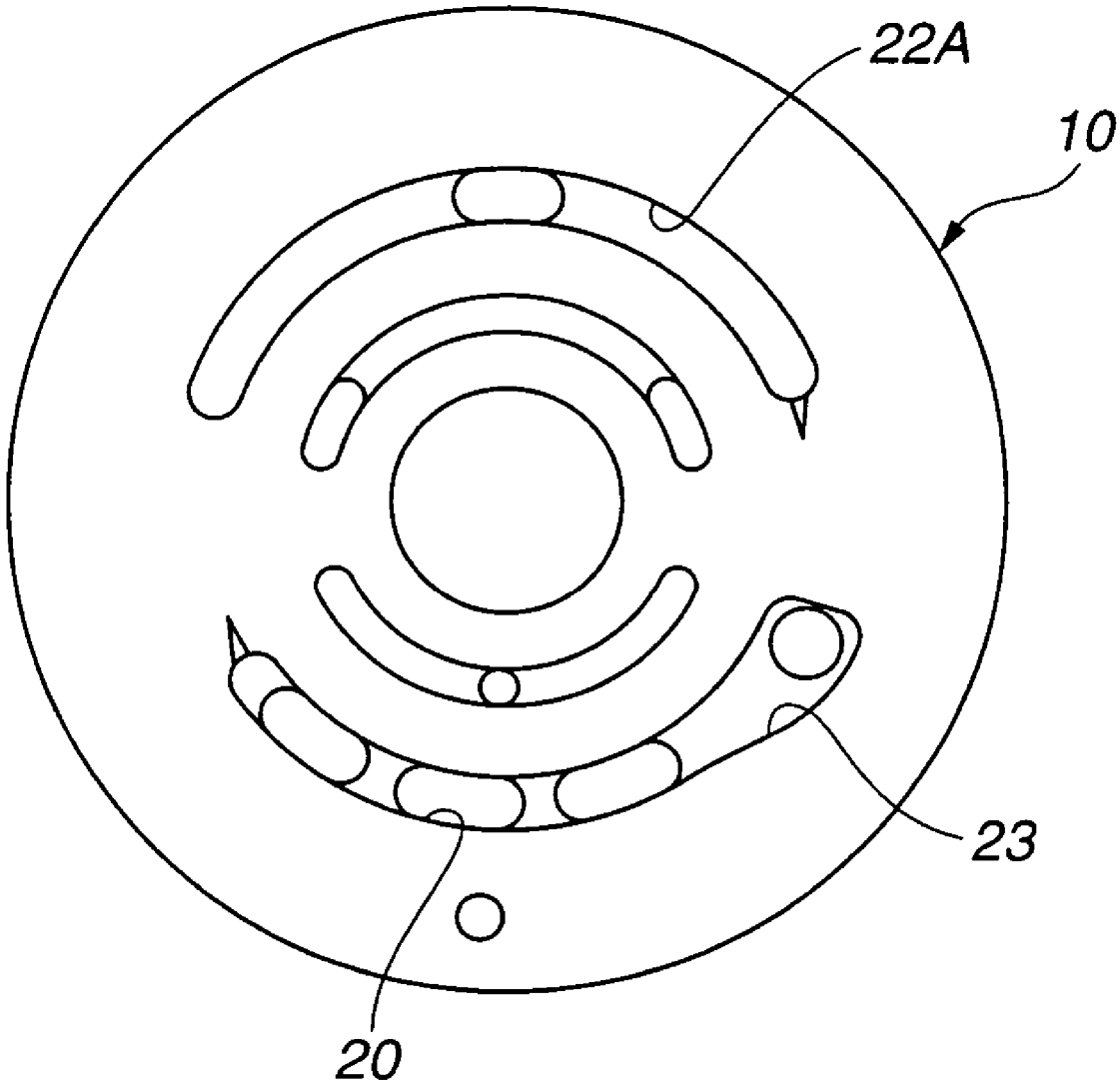
FIG. 4 is a view similar to FIG. 3, seen from the line 4-4 in FIG. 2.

Referring to FIGS. 3 and 4, suction ports 22, 22A of roughly circular groove are formed in rear cover 4 and side plate 10 at the position facing the suction area of cam ring 7, wherein suction port 22 of rear cover 4 is directly connected to suction passage 18. Likewise, discharge ports 23, 23A of roughly circular groove are formed in rear cover 4 and side plate 10 at the position facing the discharge area of cam ring 7, wherein discharge port 23 of side plate 10 is directly connected to discharge passage 20.

As shown in FIG. 1, the pressure within first working chamber 12 is controlled by a control valve 26 which is operated in response to the pressure difference between the upstream and downstream sides of orifice 21 of discharge passage 20. The second working chamber 13 is constructed to always introduce therein low-pressure working fluid of suction passage 18.

Control valve 26 comprises a valve chest 27 formed in pump housing 2 and a bottomed cylinder-shaped spool 28 accommodated in valve chest 27 to thereby define in valve chest 27 a high-pressure chamber 29 and a low-pressure chamber 30. High-pressure chamber 29 communicates with discharge passage 20 on the upstream side of orifice 21, whereas low-pressure chamber 30 communicates with discharge passage 20 on the downstream side of orifice 21, and accommodates a return spring 31 for biasing spool 28 to high-pressure chamber 29.

Figure 5:
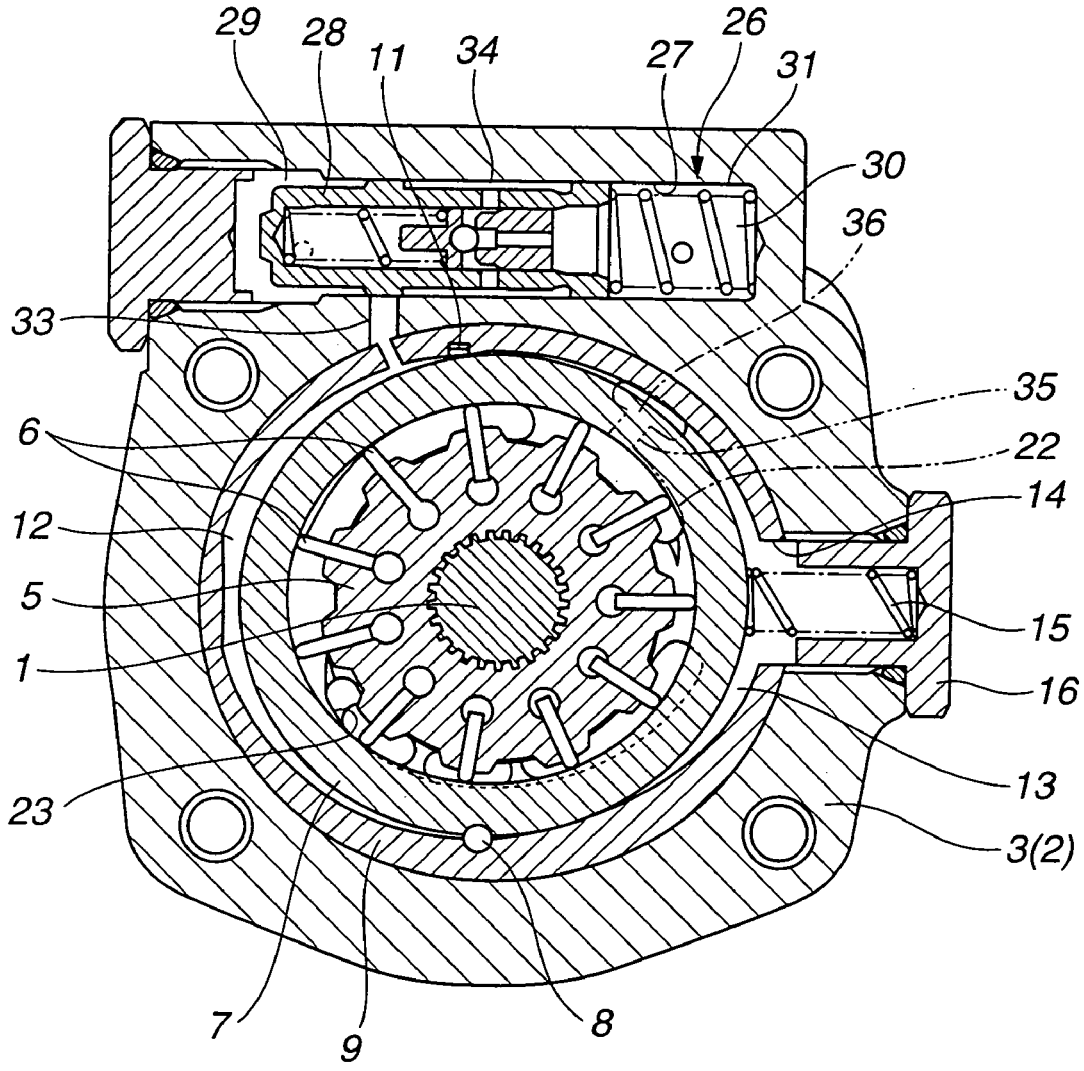
FIG. 5 is a view similar to FIG. 1, taken along the line 5-5 in FIG. 2 and showing the embodiment of the present invention.

Two axially separate passages are formed substantially in the axial center of valve chest 27: a low-pressure passage 32 branched off from suction passage 18 and a pressure introduction passage 33 which communicates with first working passage 12 passing through the peripheral wall of adaptor ring 9. An annular groove 34 is formed in the outer periphery of the shank of spool 28 to provide fluid communication between low-pressure passage 32 and pressure introduction passage 33. When spool 28 is in an initial position or a position maximally displaced to high-pressure chamber 29, annular groove 34 provides fluid communication between low-pressure passage 32 and pressure introduction passage 33. And when spool 28 is being displaced therefrom to low-pressure chamber 30 as shown in FIG. 5, annular groove 34 gradually shuts off fluid communication between low-pressure passage 32 and pressure introduction passage 33. At that time, pressure introduction passage 33 is gradually closed by a land of spool 28, then gradually opens to high-pressure chamber 29. Thus, the pressure is created in pressure introduction passage 33 in accordance with displacement of spool 28, which is introduced into first working chamber 12.

Therefore, before the pressure difference between the upstream and downstream sides of orifice 21 reaches a set pressure, low-pressure working fluid of suction passage 18 is introduced from low-pressure passage 32 into first working chamber 12 through annular groove 34 and pressure introduction passage 33. And when the pressure difference between the upstream and downstream sides of orifice 21 becomes greater than a set pressure, working fluid having pressure controlled in accordance with the pressure difference is introduced into first working chamber 12.

Referring to FIGS. 1 and 3, formed continuously in the end face of rear cover 4 on the side of cam ring 7 are a connection groove 35 which extends radially outward from suction port 22 at the position slightly offset to second working chamber 13 and a roughly circular terminal groove 36 which opens to second working chamber 13 in the vicinity of an oscillating end of cam ring 7 in the direction of reducing the amount of eccentricity. Grooves 35, 36 constitute a communication passage for providing fluid communication between suction port 22 and second working chamber 13. That is, low-pressure working fluid of suction passage 18 is always introduced into second working chamber 13 through terminal groove 36, connection groove 35, and suction port 22.

The site of rear cover 4 having connection groove 35 and terminal groove 36 formed is an area with which the side face of cam ring 7 makes slide contact during oscillation thereof. As shown in FIG. 5, part of terminal groove 36 is constructed so as not to fully be closed by cam ring 7 while cam ring 7 swings within the ordinary operation range. Note that only after cam ring 7 swings over the ordinary operation range due to abnormal pressure rise of working fluid, deformation of a component member, and the like, terminal groove is closed completely by cam ring 7.

With the above structure, when driving shaft 1 is rotated with engine start, rotor 5 rotates inside cam ring 7 in the initial state where cam ring 7 is displaced to the maximally displaced position as shown in FIG. 1. With rotation of rotor 5, pump operation is carried out inside cam ring 7, so that working fluid sucked from suction port 22 is pressurized by vanes 6, then discharged to discharge passage 20 through discharge port 23. Working fluid discharged to discharge passage 20 is supplied to power cylinder 19 through orifice 21 on one hand, and it is introduced into high-pressure chamber 29 and low-pressure chamber 30 of control valve 26 from the upstream and downstream sides of orifice 21.

Then, the pressure difference is produced between the upstream and downstream sides of orifice 21 in accordance with the discharge of the pump main body. And the resultant differential pressure acts on spool 28 of control valve 26. However, until the pressure difference reaches a set value spool 28 is pressed to high-pressure chamber 29 by return spring 31. Therefore, first working chamber 12 has low-pressure working fluid of suction passage 18 introduced therein through pressure introduction passage 33 and annular groove 34, and cam ring 7 is pressed in the direction of maximizing the amount of eccentricity by a force of coil spring 15. Moreover, until the pressure difference reaches a set value, the flow rate of working fluid supplied to power cylinder 19 increases roughly in proportion to a rise in rotational speed of rotor 5.

Then, the rotational speed of rotor 5 is relatively low to cause rather insufficient flow rate of working fluid to be supplied to power cylinder 19. However, since high-pressure working fluid discharged from the pump main body is not introduced into first and second working chambers 12, 13, there occurs no inconvenience that working fluid leaks from the clearances around first and second working chambers 12, 13 to the low-pressure portion.

When the rotational speed of rotor 5 increases to have the pressure difference between the upstream and downstream sides of orifice 21 greater than a set value, spool 28 of control valve 26 is displaced in valve chest 27 in accordance with the pressure difference. The pressure created in accordance with the displacement is introduced into first working chamber 12 through pressure introduction passage 33. Thus, cam ring 7 is pressed in the direction of second working chamber 13 by a force corresponding to the pressure difference, swinging inside adaptor ring 9 in such a way as to balance with a force of coil spring 15. As a result, the flow rate of working fluid supplied to power cylinder 19 is maintained roughly at a set value.

In this embodiment, means for introducing low-pressure working fluid of suction passage 18 into second working chamber 13 include connection groove 35 and terminal groove 36 formed in the end face of rear cover 4 on the side of cam ring 7. Thus, as compared with the related-art pump wherein an axial hole for introducing the low-pressure working fluid into second working chamber 13 is arranged parallel to suction port 22, suction passage 18 can be laid out relatively freely. That is, in this embodiment, suction passage 18 does not need to necessarily be arranged at the rear of second working chamber 13. Even when suction passage 18 and second working chamber 13 are disposed away from each other, low-pressure working fluid of suction passage 18 can surely be introduced into second working chamber 13.

In this embodiment, the communication passage for connecting suction port 22 and second working chamber 13 includes connection groove 35 and terminal groove 36. Optionally, the communication passage may include a hole and the like formed substantially along the end face of rear cover on the side of cam ring 7. Note that when the communication passage is formed by a groove which opens to the side of cam ring 7 as in this embodiment, there is an advantage of easy machining and reduced manufacturing cost.

Further, in the case that the communication passage is formed by connection groove 35 and terminal groove 36 as in this embodiment, when cam ring 7 swings in the direction of reducing the amount of eccentricity, the upper portion of connection groove 35 is closed gradually by cam ring 7 to increase a flow resistance of working fluid between suction port 22 and second working chamber 13 accordingly. Therefore, when swinging abruptly from this state, cam ring 7 undergoes a damping effect resulting from the flow resistance, allowing restraint of sensitive motion thereof.

Figure 6:
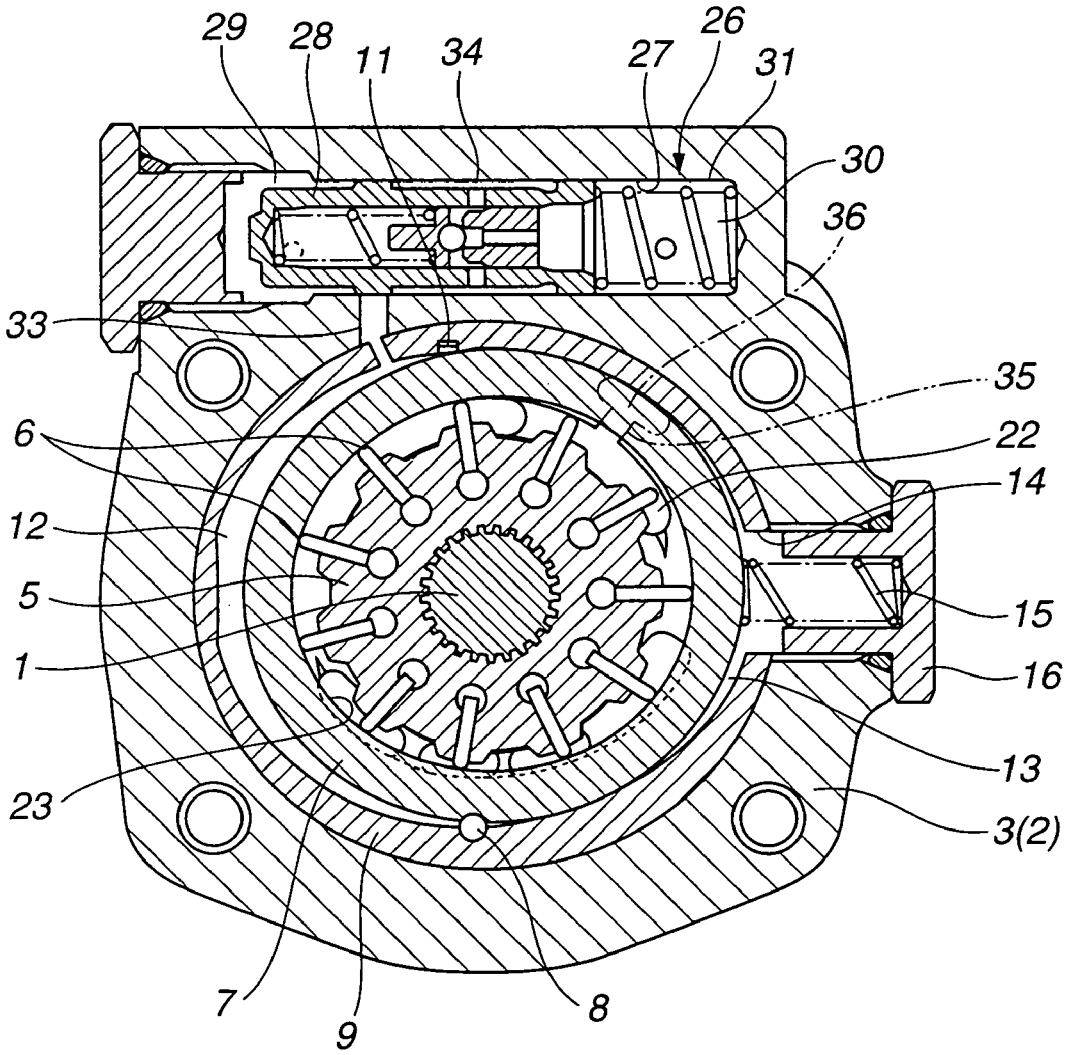
FIG. 6 is a view similar to FIG. 5, taken along the line 6-6 in FIG. 2 and showing the embodiment of the present invention.

In this embodiment, since terminal groove 36 opens to second working chamber 13 while cam ring 7 swings within the ordinary operation range, there occurs no inconvenience that smooth operation of cam ring 7 is impaired by closing of the inside of second working chamber 13. Note that, in this embodiment, when cam ring 7 swings over the ordinary operation range, i.e. cam ring 7 moves over a prescribed range due to some abnormality, terminal groove 36 is closed by cam ring 7 to close the inside of second working chamber 13 as shown in FIG. 6. As a result, a result, greater oscillation of cam ring 7 than required is surely restrained.

Figure 7:
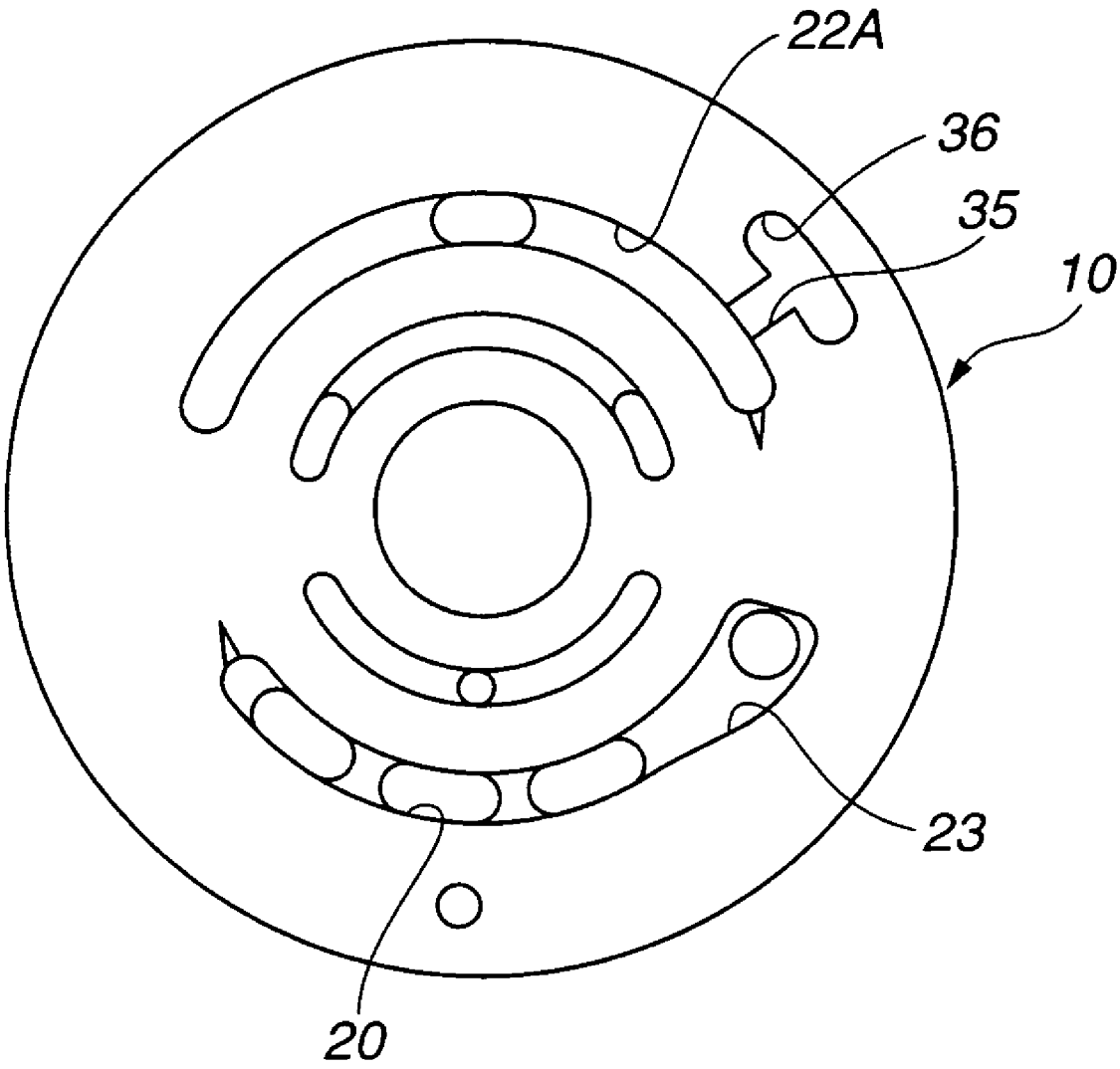
FIG. 7 is a view similar to FIG. 4, showing another embodiment of the present invention.

Having described the present invention in connection with the illustrative embodiment, the present invention is not limited thereto, and various changes and modifications can be made without departing from the scope of the present invention. By way of example, in the embodiment as described above, the communication passage (connection groove 35 and terminal groove 36) is formed in rear cover 4 which is one of the closing members for closing the side of cam ring 7. Optionally, in another embodiment shown in FIG. 7, the communication passage may be formed in side plate 10 which is another closing member. Moreover, the communication passage may be formed in the closing members on both sides of cam ring 7.

As described above, according to the present invention, the communication passage comprises a groove formed substantially along the end face of the at least one closing member. Thus, the communication passage can be obtained easily by machining to the end face of the closing member.

Further, according to the present invention, the groove comprises a terminal-groove portion which opens to the second working chamber in the vicinity of a swinging end of the cam ring in the direction that the cam ring is reduced in an amount of eccentricity with respect to the rotor, and a connection-groove portion which provides fluid communication between the suction port and the terminal-groove portion substantially along the direction of oscillation of the cam ring. With this structure, when the cam ring swings in the direction of reducing the amount of eccentricity, the upper portion of the connection-groove portion is closed gradually by the side face of the cam ring. Therefore, when swinging abruptly from this state, the cam ring undergoes a damping effect resulting from the flow resistance, allowing restraint of sensitive motion thereof.

Still further, according to the present invention, the communication passage is configured to open to the second working chamber when the cam ring swings maximally within an operation range in the direction that the cam ring is reduced in an amount of eccentricity with respect to the rotor. With this structure, since the groove constituting communication passage is not closed completely within the operation range, the negative pressure is less produced within the second working chamber during operation of the cam ring. Thus, smooth operation of the cam ring can be maintained at all times.

Furthermore, according to the present invention, the communication passage is isolated from the second working chamber when the cam ring swings over the operation range. With this structure, when the cam ring swings over the operation range due to abrupt pressure variation and the like, the communication passage is closed by the cam ring to put the second working chamber in a roughly hermetically closed state. Then, the volume of the second working chamber cannot vary, thus restraining further oscillation of the cam ring.

Further, according to the present invention, the communication passage for providing fluid communication between the suction port and the second working chamber is formed roughly along the end face of the at least one closing member on the side of the cam ring to allow introduction of low-pressure working fluid of the suction passage into the second working chamber through the suction port. Thus, the suction passage does not need to necessarily be arranged at the rear of the second working chamber, resulting in enhanced design flexibility of the pump as compared with the related-art pump.

The entire teachings of Japanese Patent Application P2003-279867 field Jul. 25, 2003 are hereby incorporated by reference.

What is claimed is:

1. A variable displacement pump, comprising:

a rotor rotated by a driving shaft, the rotor comprising a plurality of vanes mounted to be retractable radially;

a cam ring arranged on a periphery of the rotor to be swingable with respect to the rotor;

a pair of closing members arranged on both sides of the cam ring, the closing members making slide contact with the cam ring, at least one closing member having an end face on a side of the cam ring, the end face being formed with a suction port;

a seal member arranged in a chamber formed between a pump housing and the cam ring, the seal member dividing the chamber into two portions that define first and second working chambers;

a spring arranged in the second working chamber, the spring biasing the cam ring to the first working chamber in the direction that increases volumes of pump chambers defined between the cam ring, the rotor, and the vanes;

a suction passage which introduces a working fluid into a suction area within the cam ring, the suction area serving to suck the working fluid through the suction port, the suction passage and the second working chamber being always in fluid communication during pump operation;

a discharge passage which supplies the working fluid from a discharge area within the cam ring to the outside;

a communication passage formed in the at least one closing member substantially along the end face thereof, the communication passage providing fluid communication between the suction port and the second working chamber;

an orifice provided to the discharge passage; and a control valve operated by a pressure difference between upstream and downstream sides of the orifice, the control valve controlling a pressure of the working fluid to be introduced into the first working chamber and being isolated from the second working chamber.

2. The variable displacement pump as claimed in claim 1, wherein the communication passage comprises a groove formed in the end face of the at least one closing member.

3. The variable displacement pump as claimed in claim 2, wherein the groove comprises a terminal-groove portion which opens to the second working chamber in the vicinity of a swinging end of the cam ring in the direction that the cam ring is reduced in an amount of eccentricity with respect to the rotor, and a connection-groove portion which provides fluid communication between the suction port and the terminal-groove portion substantially along the direction of oscillation of the cam ring.

4. The variable displacement pump as claimed in claim 2, wherein the communication passage is configured to open to the second working chamber when the cam ring swings maximally within an operation range in the direction that the cam ring is reduced in an amount of eccentricity with respect to the rotor.

5. The variable displacement pump as claimed in claim 4, wherein the communication passage is isolated from the second working chamber when the cam ring swings over the operation range.

6. A variable displacement pump with a rotor rotated by a driving shaft and comprising a plurality of vanes mounted to be retractable radially, a cam ring arranged on a periphery of the rotor to be swingable with respect to the rotor, a seal member arranged in a chamber formed between a pump housing and the cam ring and for dividing the chamber into two portions that define first and second working chambers, a spring arranged in the second working chamber and for biasing the cam ring to the first working chamber in the direction that increases volumes of pump chambers defined between the cam ring, the rotor, and the vanes, a suction passage which introduces a working fluid into a suction area within the cam ring, a discharge passage which supplies the working fluid from a discharge area within the cam ring to the outside, an orifice provided to the discharge passage, and a control valve operated by a pressure difference between upstream and downstream sides of the orifice, the control valve controlling a pressure of the working fluid to be introduced into the first working chamber and being isolated from the second working chamber, wherein the suction passage and the second working chamber are always in fluid communication during pump operation, the variable displacement pump comprising:

a pair of closing members arranged on both sides of the cam ring, the closing members making slide contact with the cam ring, at least one closing member having an end face on a side of the cam ring, the end face being formed with a suction port through which the suction area sucks the working fluid; and a communication passage formed in the at least one closing member substantially along the end face thereof, the communication passage providing fluid communication between the suction port and the second working chamber.

* * * * *